US006364117B1

(12) United States Patent
Takano et al.

(10) Patent No.: US 6,364,117 B1
(45) Date of Patent: Apr. 2, 2002

(54) METHOD OF SEPARATING IRON SHEETS FROM WASTED IRON PRODUCTS

(75) Inventors: Hiroshi Takano, Kouka-gun; Tetsushi Yonekawa, Otsu; Takashi Okada, Yasu-gun, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/577,584

(22) Filed: May 25, 2000

(30) Foreign Application Priority Data

May 27, 1999 (JP) ..... 11-148220

(51) Int. Cl.[7] ..... B03C 1/00

(52) U.S. Cl. ..... 209/214; 209/223.1; 209/636; 241/24.14

(58) Field of Search ..... 209/213, 214, 209/215, 223.1, 225, 231, 636; 241/24.1, 24.14

(56) References Cited

U.S. PATENT DOCUMENTS 4,055,489 A * 10/1977 Soley ..... 209/231 X
4,738,367 A * 4/1988 Barrett ..... 209/223.1
5,394,448 A * 2/1995 Guiroy et al. ..... 241/24.14 X

FOREIGN PATENT DOCUMENTS

JP 52-32170 * 3/1977 ..... 209/223.1

* cited by examiner

*Primary Examiner*—Tuan N. Nguyen
(74) *Attorney, Agent, or Firm*—Wenderoth, Lind & Ponack, L.L.P.

(57) ABSTRACT

This invention pertains to a method of separating iron sheets from washed iron products. The method includes the following steps: crushing wasted iron products into pieces; transporting the crushed pieces on a conveyer; and separating iron sheet pieces from the crushed pieces on the conveyer by virtue of a magnetic separator placed over the conveyer, wherein the iron sheet pieces staying on the conveyer in a standing state are selectively subjected to an upward force. By applying the upward force to the sheet-shaped iron pieces staying on the conveyer, the balance between magnetic and gravitational force is lost and the iron sheet pieces are smoothly attracted by the magnetic separator.

24 Claims, 2 Drawing Sheets

METHOD OF SEPARATING IRON SHEETS FROM WASTED IRON PRODUCTS

BACKGROUND OF THE INVENTION

1. Field of the Invention

The present invention relates to a method of separating iron sheets from wasted iron products, which are parts of wasted electric products such as air-conditioners or refrigerators.

2. Description of the Prior Art

Recently, in view of environmental protection, many attempts have been made to recycle ferrous material from wasted iron products that constitute a part of electric products such as air-conditioners or refrigerators. However, because of low selecting accuracy and low recycling efficiency of the conventional recycling systems, obtained cast material is used only as lower-class iron material.

In the conventional iron recycling methods, wasted iron products are crushed into pieces and iron pieces are magnetically separated therefrom. Collected iron pieces are thrown into a furnace and recycled as cast material. However, when separating the iron scraps from the crushed pieces, sheet-shaped iron scraps and iron cast blocks are not distinguished and collected together. Therefore, when they are thrown into the furnace, the heavy cast blocks fall downwardly into the furnace, but the light-weight ferrous sheets are apt to be blown up by a hot blast within the furnace. The blown-up ferrous sheets are not reused and enter into an inhaling mechanism of the furnace, which may cause a mechanical trouble of the furnace.

Further, thin sheet-shaped scraps are torn and pressed in the crushing process to have a twisted shape. Scraps shaped in such a manner are apt to wind around other scraps, which make it difficult to separate the scraps. Accordingly, it is preferable that the sheet-shaped scraps are separated in an early step of the recycling.

To solve these problems, the U.S. patent application Ser. No. 09/456838, for example, describes a recycling method as follows: First, only sheet-shaped scraps are magnetically separated, and then, ferrous cast blocks are magnetically separated from the crushed pieces of the wasted iron products. Among the separated cast blocks, relatively light ones are sandwiched by the sheet scraps and pressed together. The combined ferrous piece has enough weight to be thrown into the furnace without flying up by the hot blast in the furnace. Thus, iron material can be recycled safely and with high efficiency. Also, since the sheet-shaped scraps are separated in an early step of the recycling, the entwining of the scraps is prevented. The sheet-shaped scraps can be selectively separated by controlling the magnetic flux density of the conventional magnetic separator.

The reason why the sheet-shaped scraps can be selectively separated is as follows: A capability of attracting the ferrous pieces by the magnetic separator depends on a difference between magnetic and gravitational force applied on the ferrous piece. The magnetic force on the ferrous piece depends on a magnetic flux density and a surface area of the ferrous piece. Since the sheet-shaped scraps are torn and pressed in the crusher to have a long and twisted shape, the sheet-shaped iron scraps have larger surface areas than those of the cast iron blocks. Accordingly the magnetic force applied on the sheet-shaped scrap is stronger than that on the same-weight cast block. Therefore, an adequate control of the magnetic flux density leads to selective attraction of the sheet-shaped iron scraps.

FIG. 3 shows a process for selectively separating the sheet-shaped iron scraps from crushed pieces of the iron products. The crushed pieces 14, including iron sheet pieces 16, cast iron blocks 18 and non-iron pieces 20, are transported on a conveyer 10, such as a vibrating conveyer. A magnetic separator 12 is placed over the conveyer 10 and set to provide an adequate magnetic flux density so that the iron sheet pieces 16 can be selectively attracted. Among the crushed pieces 14 moving from the right side in the figure, only the iron sheet pieces 16 are attracted by the magnetic separator 12. The rest of the pieces 14, the cast blocks 18 and non-ferrous pieces 20, are carried to the next step, in which the cast blocks 18 are separated.

In this method, the sheet-shaped iron pieces 16 are selectively attracted by utilizing the difference in the surface area per weight. However, because of a variation in the shapes of the iron sheet pieces 16, in some cases, the magnetic force may become equal to the gravitational force on the iron sheet pieces 16. Accordingly, some of the iron sheet pieces 16 are apt to remain on the conveyer 10. The presence of these residual iron sheet pieces 16 not only decreases the recycling efficiency but also causes problems as set forth below.

The residual sheet pieces 16 are affected by the magnetic force to stay under the magnetic separator 12, and wind around the cast blocks 18 and the non-ferrous pieces 20 carried after the residual sheet pieces 16. This causes a jam on the conveyer 10 and prevents a smooth operation of the recycling system. Further, the entwining between the iron sheet pieces 16 and other pieces makes it difficult to separate them in the following steps.

Most of the residual sheet pieces 16 eventually move forward with other crushed pieces 14 and they are attracted with the cast blocks 18 in the next magnetic separating step. On the other hand, a part of the residual iron sheet pieces 16 lose the balance between the magnetic and gravitational force by collision with other pieces and they are attracted by the magnetic separator 12 along with light-weight non-ferrous pieces 20 such as copper wires. Thus, some iron sheet pieces 16 are mixed in the collected cast blocks 18, and some non-ferrous pieces 20 are mixed in the collected iron sheet pieces 16. The mixing of the iron sheet pieces 16 with the cast blocks 18 gives an unfavorable influence to the sandwich-press process of the cast blocks 18. The mixing of the non-ferrous pieces 20 with the iron sheet pieces 16 reduces the purity of the recycled cast material.

SUMMARY OF THE INVENTION

It is accordingly an object of the present invention to provide a method of separating iron sheets from wasted iron products wherein the iron sheets are smoothly recycled with high efficiency.

According to the present invention, a method of separating iron sheets from wasted iron products comprises the steps of:

crushing wasted iron products into pieces;

transporting said crushed pieces on a conveyer;

separating iron sheet pieces from said crushed pieces on said conveyer by means of a magnetic separator placed over said conveyer, wherein said iron sheet pieces staying on said conveyer in a standing state are selectively subjected to an upward force.

By applying the upward force to the sheet-shaped iron pieces staying on the conveyer, the balance between the magnetic and gravitational force is lost and the sheet-shaped pieces are smoothly attracted by the magnetic separator.

Thus, the remaining sheet-shaped pieces on the conveyor are prevented and the recycling efficiency of the iron material is improved.

The upward force is preferably applied by hitting an upper portion of the iron sheet piece with an upwardly directed force. The iron sheet piece staying on the conveyer is in a standing state under the balance of magnetic and gravitational force. Accordingly, the iron sheet piece staying on the conveyer is taller than other crushed pieces. Utilizing this difference in the height between the iron sheet piece and other pieces, it becomes possible to hit the upper portion of the iron sheet piece selectively. In order to break the balance of the magnetic and gravitational force on the iron sheet piece, only a little force is required.

In order to hit the iron sheet piece, a variety of means can be employed. For example, a rotor placed so as to hit the upper portion of the iron sheet pieces may be used. The rotor is preferably rotating in an inverse direction relative to the moving direction of the conveyer so that the upward force is effectively applied to the iron sheet pieces. Alternatively, a pendulum may be employed to hit the iron sheet pieces.

The rotor or pendulum is preferably placed under the magnetic separator and near the end of the magnetic separator. With this arrangement, the iron sheet pieces are hit toward an attracting area of the magnetic separator. Also, this arrangement broadens the attracting area of the iron sheet pieces. Accordingly, the attraction of the iron sheet pieces becomes smooth.

In this specification, the term "wasted iron products" means wasted products composed of iron-based metal or wasted products having a lot of such metal parts.

BRIEF DESCRIPTION OF THE DRAWINGS

The above and other objects and features of the present invention will become more apparent from description of a preferred embodiment thereof with reference to the accompanying drawings, throughout which like parts are designated by like reference numerals, and wherein.

DETAILED DESCRIPTION OF THE PREFERRED EMBODIMENTS

The application is based on an application No. 11-148220 filed in Japan, the content of which is incorporated herein by reference.

Embodiment 1

Hereinafter, the separating process of iron sheets from wasted iron products in accordance with this invention will be described in terms of a separation of iron sheets from a compressor in a wasted electric product, such as an air conditioner or a refrigerator.

First, the compressor is crushed into pieces by means of a crusher. The crushed pieces generally include iron sheet pieces, cast iron blocks and non-ferrous pieces. In the case with a compressor in a home-use air conditioner; a rotor and a stator core become the iron sheet pieces; a cylinder, a piston and a shaft become the cast iron blocks; and a copper coil and plastic parts become the non-ferrous pieces.

It is advantageous to crush the pieces into a size smaller than a predetermined value (e.g., ≦30 mm). The size of the pieces can be controlled by means of a screen having a plurality of predetermined-size holes The screen is placed, for example, under the crusher.

For the crushing step, various kinds of crushers may be employed. However, a rotary crusher having a rotor with hammers mounted on its periphery is preferable. The iron sheet is torn and pressed in the crusher, and, after the crushing, the pieces of the iron sheets have a twisted shape. On the other hand, the pieces of the cast iron have a chunky shape after the crushing. The non-iron pieces have variety of shapes according to their material. For example, copper wires have a cooked shape after crushing.

Figure 1:
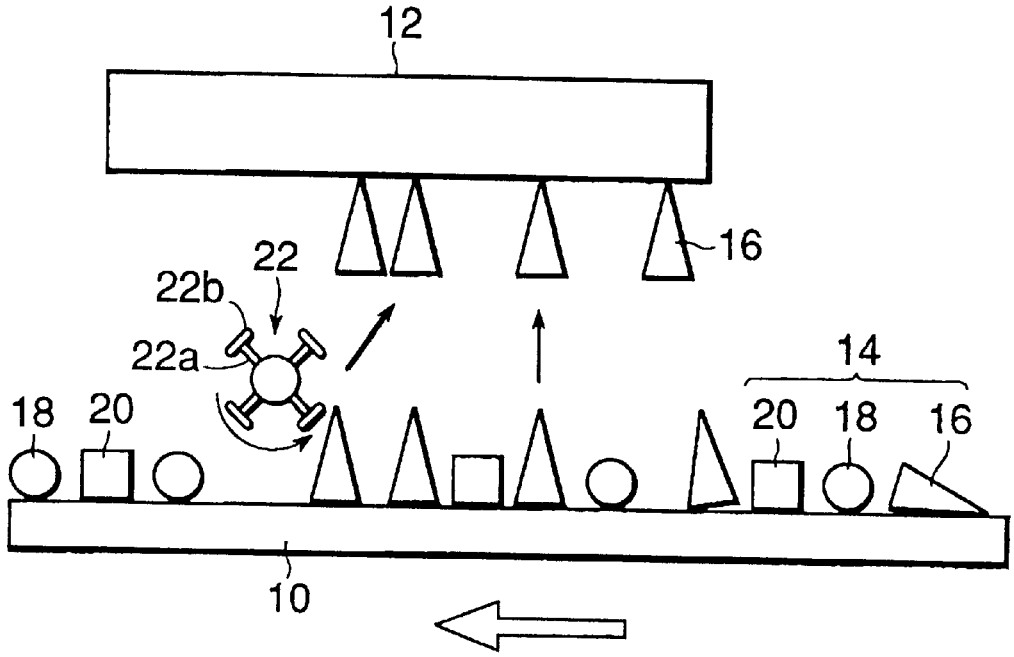
FIG. 1 is a schematic illustration of a transporting step and a separating step of the separating method according to embodiment 1 of the present invention.

Next, as shown in FIG. 1, the crushed pieces 14 including iron sheet pieces 16, cast iron blocks 18 and non-iron pieces 20 are transported on a vibrating conveyer 10, for example. A magnetic separator 12, such as a suspended-type magnetic separator, is placed above the conveyer 10. The magnetic separator 12 is set to provide such a magnetic flux density as to attract only the iron sheet pieces 16 (e.g., 180 gauss).

When the crushed pieces 14 pass under the magnetic separator 12, the iron sheet pieces 16 and cast iron blocks 18 receive a magnetic force proportional to their surface area. Most iron sheet pieces 16 are attracted by the magnetic separator 12, since the magnetic force is greater than the gravitational force. However, a part of the iron sheet pieces 16 stays on the conveyer 10 in a standing state, since the magnetic force is equivalent to the gravitational force thereon. The cast blocks 18, as well as the non-iron pieces 20, pass under the magnetic separator 12, since the gravitational force is greater than the magnetic force.

A rotor 22 (a hitting means) is placed between the magnetic separator 12 and the vibrating conveyer 10, rotating by means of a motor. The rotor 22 is mounted at such a height as to hit the upper portion of the iron sheet pieces 16 standing on the conveyer 10. For example, the lower end of the rotor 22 is placed a 50-mm height. When the iron sheet piece 16 approaches the rotor 22, the upper portion of the iron sheet piece 16 is hit upwardly. Thus, the iron sheet piece 16 receives an upward force, which breaks the balance of the magnetic force and the gravitational force. Accordingly, the iron sheet pieces 16 are smoothly attracted by the magnetic separator 12 without staying on the conveyer 10. Since the cast iron blocks 18 and the non-iron pieces 20 are not standing and are shorter in height than the iron sheet pieces 16, the cast blocks 18 and the non-iron pieces are hardly hit by the rotor 22.

The rotor 22 may have a variety of configurations. For example, it is preferable that the rotor 22 has a plurality of projections **22*a* on its periphery. More advantageously, a hitting member 22*b*, such as an angle iron, of a predetermined length (e.g., about 10 mm) is attached to the terminal end of each projection 22*a* such that the projection 22*a* and hitting member 22*b* define a shape of "T" or "L", so as to prevent slipping and effectively apply an upward force to the iron sheet piece. In order to hit the upper portion of the iron sheet piece 16 in a generally upright direction, it is preferable that the hitting member 22*b* of the rotor contact the iron sheet piece 16 when the hitting member 22*b* passes its lowest position of rotation. Therefore, the rotor 22 preferably rotates in an inverse direction relative to the moving direction of the conveyer 10. It is also preferable that a moving speed of the hitting member 22*b* is much faster than that of the conveyer 10** (e.g., the rotating speed is preferably about 100 rpm).

The rotor 22 may be placed at any position as long as the rotor 22 can hit the upper portion of the iron sheet pieces 16. When the rotor 22 rotates inversely relative to the transporting direction of the conveyer 10, the rotor 22 is preferably placed under the magnetic separator 12 and near the end of the magnetic separator 12. For example, the rotor 22 is preferably placed within a distance that is ⅓ of a total length of the magnetic separator 12 from the end thereof With this arrangement, the iron sheet pieces 16 are hit toward an attracting area of the magnetic separator 12, and the attracting area of the iron sheet pieces 16 is broadened. Accordingly, the attraction of the iron sheet pieces 16 becomes smooth.

Embodiment 2

Figure 2:
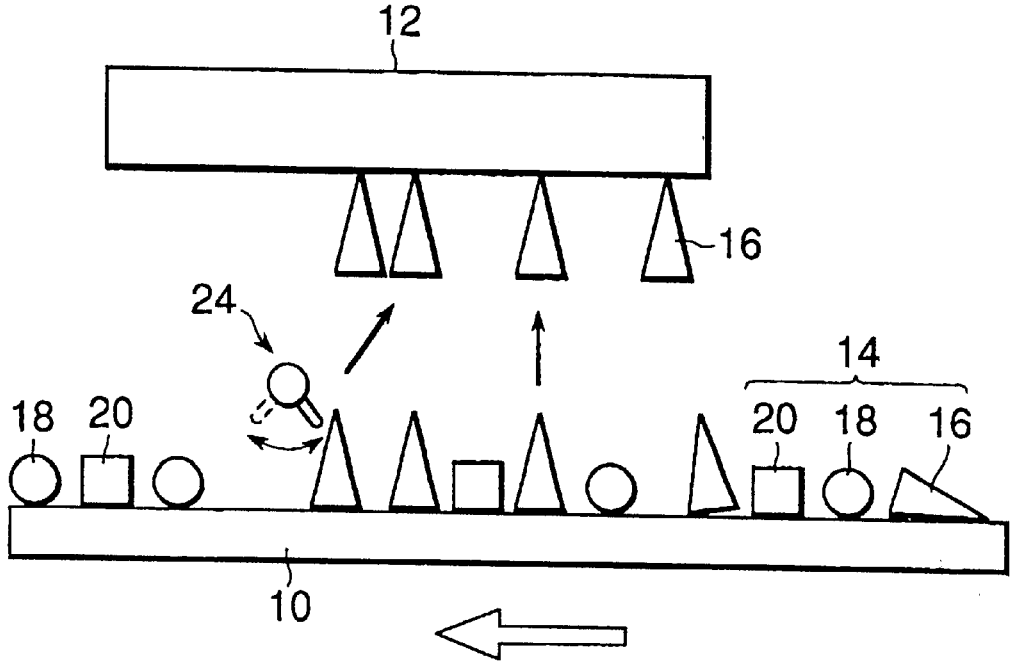
FIG. 2 is a schematic illustration of a transporting step and a separating step of the separating method according to an embodiment 2 of the present invention.
Figure 3:
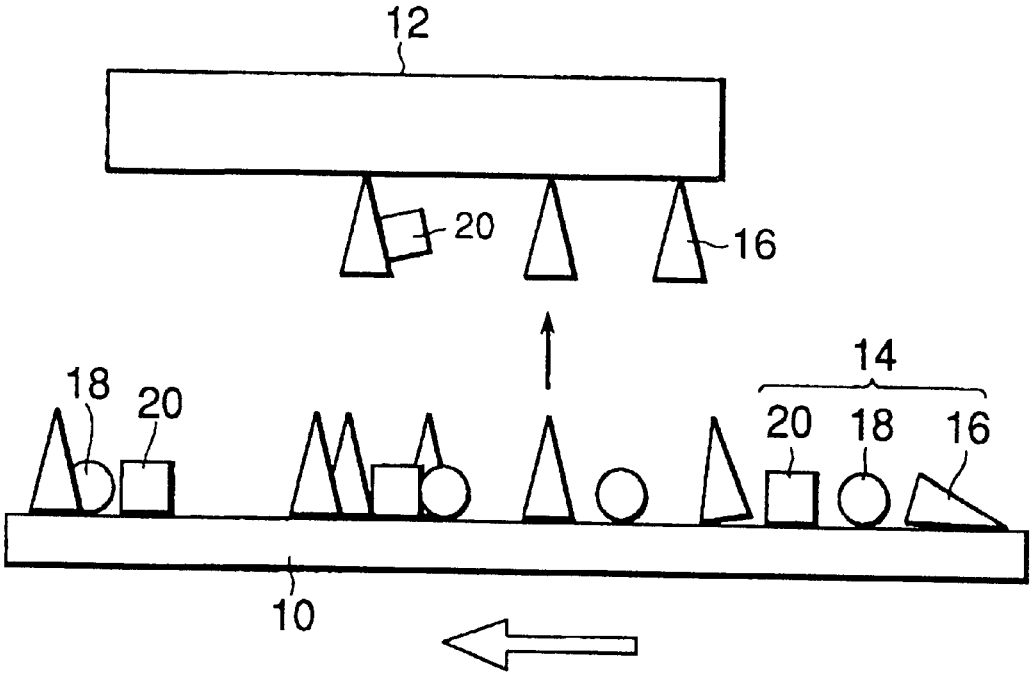
Fig.3 PRIOR ART
FIG. 3 is a schematic illustration of a transporting step and a separating step of the conventional separating method.

FIG. 2 shows another embodiment of the present invention, in which a different hitting means is employed. Other devices are same as those in embodiment 1.

In this embodiment, the hitting means 24 is a swinging pendulum placed so as to hit the upper portion of the iron sheet pieces 16 standing on the conveyer 10. As well as the rotor in embodiment 1, it is preferable that the pendulum 24 is placed under the magnetic separator 12 and near the end of the magnetic separator 12 and that moving speed of the pendulum 24 is much faster than transporting speed of the conveyer 10. By, hitting the iron sheet pieces 16 with the pendulum 24, the balance of the magnetic and gravitational force on the piece is lost, which prevents the iron sheet pieces 16 from remaining on the conveyer 10.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be constructed as being included therein.

What is claimed is:

1. A method of separating magnetic pieces of material from other pieces of material, comprising:

providing pieces of material, with at least some of said pieces of material being magnetic pieces of material;

transporting said pieces of material by moving a conveyor while said pieces of material are on said conveyor; and separating said magnetic pieces of material from other of said pieces of material, while said pieces of material are being transported by said conveyor, by applying a magnetic force and an upwardly directed force to said magnetic pieces of material, wherein the application of said upwardly directed force to said magnetic pieces of material aids said magnetic pieces of material in being attracted by said magnetic force.

2. The method according to claim 1, wherein the provision of said pieces of material comprises crushing wasted products into said pieces of material.

3. The method according to claim 2, wherein the application of the magnetic force to said magnetic pieces of material comprises applying the magnetic force via a magnetic separator that is positioned above said conveyor.

4. The method according to claim 3, wherein said magnetic pieces of material comprise iron sheets.

5. The method according to claim 4, wherein the application of said upwardly directed force to said magnetic pieces of material comprises using a hitting device to hit an upper portion of said iron sheets.

6. The method according to claims 5,wherein using a hitting device to hit an upper portion of said iron sheets comprises using a rotor to hit the upper portion of said iron sheets.

7. The method according to claim 6, wherein the transportation of said pieces of material by moving a conveyor while said pieces of material are on said conveyor comprises moving said conveyor in a first direction while said pieces of material are on said conveyor, and using a rotor to hit the upper portion of said iron sheets comprises rotating said rotor such that when said rotor hits the upper portion of said iron sheets said rotor is traveling in a direction that is generally opposite to said first direction.

8. The method according to claim 5, wherein using a hitting device to hit an upper portion of said iron sheets comprises using a pendulum to hit the upper portion of said iron sheets.

9. The method according to claim 8, wherein the transportation of said pieces of material by moving a conveyor while said pieces of material are on said conveyor comprises moving said conveyor in a first direction while said pieces of material are on said conveyor, and using a pendulum to hit the upper portion of said iron sheets comprises swinging said pendulum such that when said pendulum hits the upper portion of said iron sheets said pendulum is traveling in a direction that is generally opposite to said first direction.

10. The method according to claim 5, wherein using a hitting device to hit an upper portion of said iron sheets comprises using a hitting device, positioned beneath said magnetic separator and near an end of said magnetic separator, to hit the upper portion of said iron sheets.

11. The method according to claim 1, wherein the application of said upwardly directed force to said magnetic pieces of material comprises using a hitting device to hit an upper portion of said magnetic pieces of material.

12. The method according to claim 11, wherein using a hitting device to hit the upper portion of said magnetic pieces of material comprises using a rotor to hit the upper portion of said magnetic pieces of material.

13. The method according to claim 12, wherein the transportation of said pieces of material by moving a conveyor while said pieces of material are on said conveyor comprises moving said conveyor in a first direction while said pieces of material are on said conveyor, and using a rotor to hit the upper portion of said magnetic pieces of material comprises rotating said rotor such that when said rotor hits the upper portion of said magnetic pieces of material said rotor is traveling in a direction that is generally opposite to said first direction.

14. The method according to claim 11, wherein using a hitting device to hit the upper portion of said magnetic pieces of material comprises using a pendulum to hit the upper portion of said magnetic pieces of material.

15. The method according to claim 14, wherein the transportation of said pieces of material by moving a conveyor while said pieces of material are on said conveyor comprises moving said conveyor in a first direction while said pieces of material are on said conveyor, and using a pendulum to hit the upper portion of said magnetic pieces of material comprises swinging said pendulum such that when said pendulum hits the upper portion of said magnetic pieces of material said pendulum is traveling in a direction that is generally opposite to said first directions.

16. The method according to claim 1, wherein the provision of said pieces of material comprises crushing wasted iron products into said pieces of material.

17. The method according to claim 16, wherein the application of the magnetic force to said magnetic pieces of material comprises applying the magnetic force via a magnetic separator that is positioned above said conveyor.

18. The method according to claim 17, wherein the crushing of the wasted iron products into said pieces of material comprises crushing wasted iron products into iron sheets and other pieces, with said iron sheets being said magnetic pieces of material that are to be separated from said other pieces.

19. The method according to claim 18, wherein the application of said upwardly directed force to said magnetic pieces of material comprises using a hitting device to hit an upper portion of said iron sheets.

20. The method according to claim 19, wherein using a hitting device to hit an upper portion of said iron sheets comprises using a rotor to hit the upper portion of said iron sheets.

21. The method according to claim 20, wherein the transportation of said pieces of material by moving a conveyor while said pieces of material are on said conveyor comprises moving said conveyor in a first direction while said pieces of material are on said conveyor, and using a rotor to hit the upper portion of said iron sheets comprises rotating said rotor such that when said rotor hits the upper portion of said iron sheets said rotor is traveling in a direction that is generally opposite to said first direction.

22. The method according to claim 19, wherein using a hitting device to hit an upper portion of said iron sheets comprises using a pendulum to hit the upper portion of said iron sheets.

23. The method according to claim 22, wherein the transportation of said pieces of material by moving a conveyor while said pieces of material are on said conveyor comprises moving said conveyor in a first direction while said pieces of material are on said conveyor, and using a pendulum to hit the upper portion of said iron sheets comprises swinging said pendulum such that when said pendulum hits the upper portion of said iron sheets said pendulum is traveling in a direction that is generally opposite to said first direction.

24. The method according to claim 19, wherein using a hitting device to hit an upper portion of said iron sheets comprises using a hitting device, positioned beneath said magnetic separator and near an end of said magnetic separator, to hit the upper portion of said iron sheets.

* * * * *